US009708172B2

(12) United States Patent
Reimann et al.

(10) Patent No.: US 9,708,172 B2
(45) **Date of Patent: *Jul. 18, 2017**

(54) LOCK-OUT DEVICE AND METHOD

(71) Applicants: Diversey, Inc., Sturtevant, WI (US); Shirley A. Webb, Dronfield Woodhouse (GB)

(72) Inventors: Kirk Reimann, Franksville, WI (US); William E. Simpson, New Berlin, WI (US); Nancy D. Trafelet, Racine, WI (US); Andy Swain, Nottingham (GB); David Holden, Derbyshire (GB); Garry W. Crossdale, Derbyshire (GB); Brian D. Haworth, Voorburg (NL); Bert Van Der Heijden, Bunnik (NL); Christopher J. Webb, Dronfield (GB)

(73) Assignee: Diversey, Inc., Sturtevant, WI (US)

( * ) Notice: Subject to any disclaimer, the term of this patent is extended or adjusted under 35 U.S.C. 154(b) by 135 days.

This patent is subject to a terminal disclaimer.

(21) Appl. No.: 14/810,190

(22) Filed: Jul. 27, 2015

(65) Prior Publication Data

US 2015/0329348 A1 Nov. 19, 2015

Related U.S. Application Data

(63) Continuation of application No. 12/158,463, filed as application No. PCT/US2006/060957 on Nov. 16, 2006, now Pat. No. 9,090,450.

(Continued)

(51) Int. Cl.
*B65D 88/54* (2006.01)
*B67D 7/34* (2010.01)

(52) U.S. Cl.
CPC ..... *B67D 7/34* (2013.01); *B67D 7/344* (2013.01)

(58) Field of Classification Search
CPC ..... B67D 3/0006; B67D 2001/0814; B67D 2001/0811; B67D 7/344; A47K 5/1208; A47K 5/12; F16L 2201/60
See application file for complete search history.

(56) References Cited

U.S. PATENT DOCUMENTS 4,080,737 A 3/1978 Fleer
4,280,723 A 7/1981 Moldestad
(Continued)

FOREIGN PATENT DOCUMENTS

EP 1090877 A1 4/2001
EP 1346945 A1 9/2003
(Continued)

OTHER PUBLICATIONS

International Search Report from the European Patent Office. Mar. 13, 2007.

(Continued)

*Primary Examiner* — Patrick M Buechner
(74) *Attorney, Agent, or Firm* — Michael Best & Friedrich LLP

(57) ABSTRACT

A method and device to insure that a particular dispensing package (18) can only be engaged into an appropriate dispensing location (14). Specifically, the package and the dispenser have mating concentric rings (24, 30) (or portions thereof) to prevent engagement and dispensing of an inappropriate product. In one embodiment, the package (18) is provided with one or more concentric ring projections (24) (or portions thereof) and the dispenser (10) is provided with one or more matching concentric ring recesses (30). The projections and the recesses have similar diameters to define a mating set. In some embodiments, the concentric ring projections are placed on a closure (20), such as a cap, of the package. In alternative embodiments, the projections are (Continued)

placed on the dispenser and the recesses are placed on the package.

20 Claims, 12 Drawing Sheets

Related U.S. Application Data

(60) Provisional application No. 60/753,286, filed on Dec. 22, 2005.

(56) References Cited

U.S. PATENT DOCUMENTS

| | | | |
|---|---|---|---|
| 4,619,640 | A | 10/1986 | Potolsky et al. |
| 4,634,022 | A | 1/1987 | O'Halloran et al. |
| 4,665,960 | A | 5/1987 | Brzezicki et al. |
| 4,907,019 | A | 3/1990 | Stephens |
| 5,100,030 | A | 3/1992 | Roggenburg, Jr. et al. |
| 5,277,332 | A | 1/1994 | Rogers |
| 5,452,825 | A | 9/1995 | Comstock et al. |
| 5,597,021 | A | 1/1997 | Crossdale et al. |
| 5,649,643 | A | 7/1997 | Ridgeway |
| 5,971,019 | A | 10/1999 | Imai |
| 6,349,858 | B1 | 2/2002 | Kingsford et al. |
| RE38,204 | E | 7/2003 | Kazarian |
| 6,739,577 | B2 | 5/2004 | Clancy et al. |
| 6,758,372 | B2 | 7/2004 | Studer et al. |
| 7,458,665 | B2 | 12/2008 | Batista et al. |
| 7,857,170 | B2 | 12/2010 | Ophardt |
| 7,984,826 | B2 | 7/2011 | Blacker et al. |
| 8,020,733 | B2 | 9/2011 | Snodgrass |
| 8,353,427 | B2 | 1/2013 | Landauer |
| 9,090,450 | B2 * | 7/2015 | Reimann ..... B67D 7/344 |
| 2007/0272709 | A9 | 11/2007 | Ciavarella et al. |
| 2013/0118641 | A1 | 5/2013 | Beranger |

FOREIGN PATENT DOCUMENTS

| | | | |
|---|---|---|---|
| JP | S5245724 | | 4/1952 |
| JP | 3056204 | | 11/1991 |
| JP | 2001165051 | A | 6/2001 |
| WO | 9636542 | A1 | 11/1996 |
| WO | 0016297 | A1 | 3/2000 |
| WO | 03045834 | A1 | 6/2003 |

OTHER PUBLICATIONS

Canadian Intellectual Property Office Action for Application No. 2,634,156 dated Sep. 18, 2014 (2 pages).

* cited by examiner

LOCK-OUT DEVICE AND METHOD

CROSS-REFERENCE TO RELATED APPLICATIONS

This is a continuation of U.S. patent application Ser. No. 12/158,463, filed on Dec. 11, 2009, which is a National Phase entry of International Patent Application No. PCT/US2006/060957, filed on Nov. 16, 2006, which claims priority to U.S. Provisional Patent Application No. 60/753,286, filed on Dec. 22, 2005, the contents of which are hereby incorporated by reference in their entirety.

BACKGROUND OF THE INVENTION

In many industries, the same package type (e.g., bottle or container and cap, etc.) is used with many different chemical products. Accordingly, it can be important to prevent users from inadvertently using the incorrect chemical in an application. Conventionally, the dispenser and package have been color coded to guide the user to place the package in the correct dispensing location. However, many of these conventional dispensers do not physically prevent the package from being placed in an incorrect dispensing location.

Other conventional lock-out techniques alter the shape and/or size of the bottle or container to prevent engagement of the package with an incorrect dispensing location. However, having many differently shaped bottles can be quite expensive.

SUMMARY OF THE INVENTION

The present invention relates to a method and device to insure that a particular dispensing package can only be engaged into an appropriate dispensing location. Specifically, the package and the dispenser have mating concentric rings (or portions thereof) to prevent engagement and dispensing of an inappropriate product. In one embodiment, the package is provided with one or more concentric ring projections (or portions thereof) and the dispenser is provided with one or more matching concentric ring recesses. The projections and the recesses have similar diameters to define a mating set. In some embodiments, the concentric ring projections are placed on a closure, such as a cap, for the package. In alternative embodiments, the projections are placed on the dispenser and the recesses are placed on the package.

Some embodiments of the present invention are directed toward a dispensing apparatus comprising a first package containing a first product to be dispensed at a first dispensing location. The first package has at least one projection configured and positioned about a circle having a first diameter. The first dispensing location has at least one recess positioned about a circle having the first diameter. The diameter of the projection and the recess allows the first package to engage the first dispensing location such that the first product can be dispensed from the first package.

Other embodiments are directed toward a dispensing apparatus comprising a first package containing a first product to be dispensed and a first dispensing location adapted to dispense the first product. The first package has at least one recess positioned about a circle having a first diameter. The first dispensing location has at least one projection positioned about a circle having the first diameter. The diameter of the projection and the recess allows the first package to engage the first dispensing location such that the first product can be dispensed from the first package.

One particular embodiment of the present invention is directed toward a lock-out assembly for controlling engagement between a package and a dispensing apparatus. The lock-out assembly comprises a recess positioned on either the dispensing apparatus or the package about at least portion of a circumference of a circle having a first diameter. The lock-out assembly further comprises a projection positioned on the other of the dispensing apparatus and the package about at least a portion of the circumference of a circle having the first diameter. The projection and the recess are dimensioned and configured to allow the package to engage the dispenser.

Yet other embodiments are directed toward a method of selectively allowing packages to be inserted into a dispenser. The method includes providing a first package having a first chemical and having either a projection or a recess at least partially defining the circumference of a circle having a first diameter. The method further including providing a dispenser designed to dispense the first chemical and having the other of the projection or the recess at least partially defining the circumference of a circle having the first diameter. The method also including positioning the first package adjacent the dispenser and aligning the projection or the recess on the first package with the other of the projection and the recess on the dispenser. The method further includes inserting the projection into the recess to allow product to be dispensed.

Further aspects of the present invention, together with the organization and operation thereof, will become apparent from the following detailed description of the invention when taken in conjunction with the accompanying drawings.

DETAILED DESCRIPTION

Figure 1:
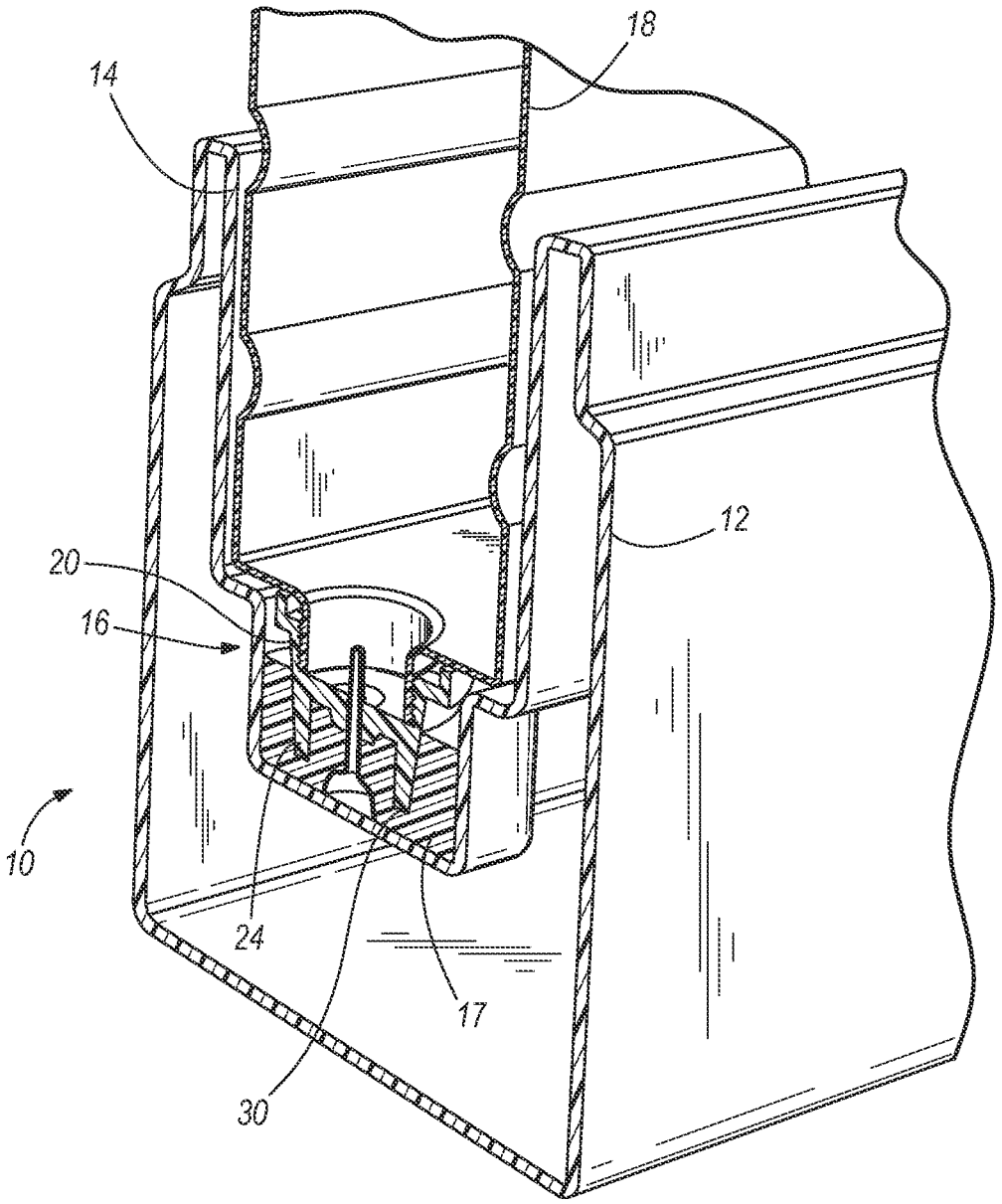
FIG. 1 is a cross-sectional perspective view of a dispensing apparatus and package embodying aspects of the present invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising," or "having" and variations thereof herein is meant to encompass the items listed thereafter and equivalents thereof as well as additional items. The terms "mounted," "connected," and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Finally, as described in subsequent paragraphs, the specific mechanical configurations illustrated in the drawings are intended to exemplify embodiments of the invention. Accordingly, other alternative mechanical configurations are possible, and fall within the spirit and scope of the present invention.

FIG. 1 illustrates a cross-sectional view of a dispensing assembly 10 embodying aspects of the present invention. The dispensing assembly 10 includes a housing 12 having a cradle 14 dimensioned and configured to receive a package or container containing items to be dispensed. Although it is not shown, the dispensing assembly 10 can include a variety of items, such as funnels, tubes, valves, electrical devices and circuitry, water lines, etc.

A coded lock-out device 16 is positioned within the cradle 14 to prevent an incorrect package from engaging the cradle 14 of the dispensing assembly 10. The cradle 14 can be provided with the coded lock-out device 16 several different ways. For example, the coded lock-out device 16 can be molded directly into the cradle 14. However, this does not allow for flexibility to dispense differently coded products at different times via this cradle 14. Some embodiments, such as the illustrated embodiment, utilize coded inserts that are positioned within the cradle 14. Accordingly, the coding within a cradle 14 can be changed to allow a different product to be dispensed via the cradle 14 by switching the coded insert 17.

As shown in FIG. 1, a package 18 is inserted in the cradle 14 and properly engaged with the cradle 14. The package 18 is properly engaged with the cradle 14 because the package 18 is properly coded to match the code of the lock-out device 16. More specifically, a closure 20 on the package 18 is provided with the coding. The closure 20 of this embodiment is a cap. The closure 20 can be coupled to the package 18 many ways, such as threaded engagement, friction fit, snap fit, welded engagement, bonded engagement, adhered engagement, etc. Since the package 18 is coded to engage the cradle 14, the package 18 can dispense its contents via the illustrated dispensing assembly 10. Additional details regarding the lock-out device 16 will be described below.

Figure 2:
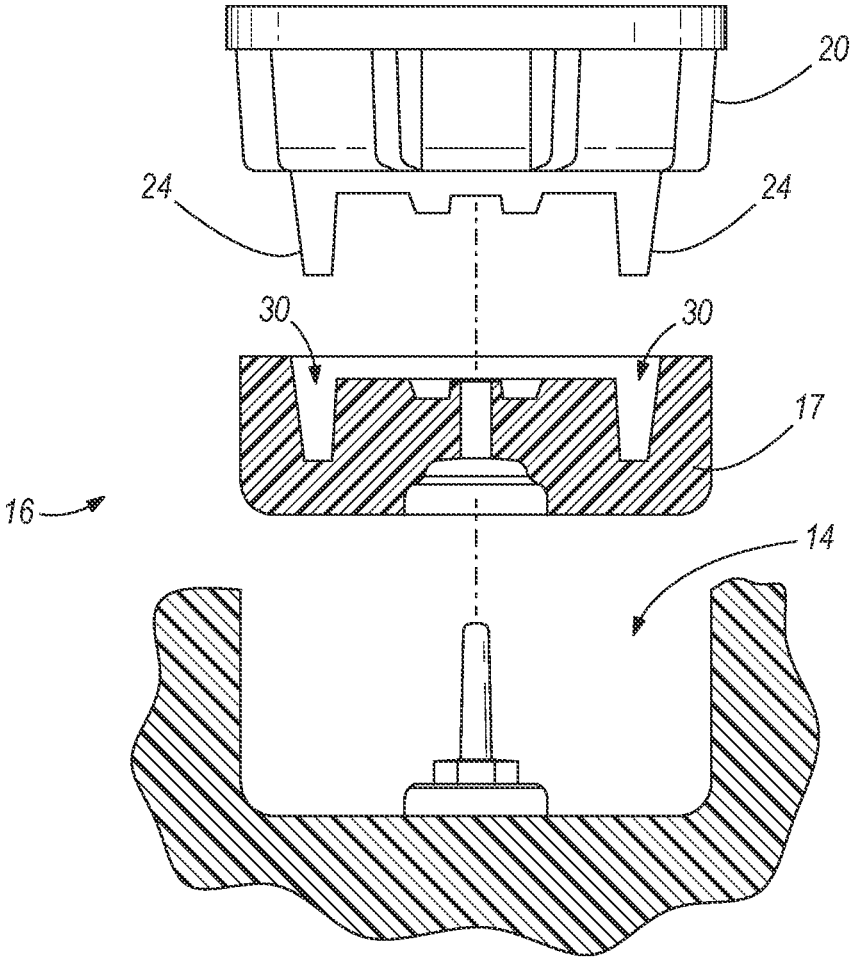
FIG. 2 is a partial cross-sectional side view a dispensing apparatus, coded dispenser insert, and coded package closure embodying aspects of the present invention.

FIG. 2 shows an exploded, partial cross-sectional view of a dispensing assembly 10. Specifically, a coded package closure 20, a coded dispenser insert 17, and a dispenser housing cradle 14 are shown in this figure. A spigot is also shown within the cradle 14. The spigot is configured and dimensioned to contact and actuate a valve mechanism on the package closure 20 as the package 18 is inserted into the cradle 14. Actuation of the valve mechanism allows the contents of the package 18 to be dispensed into the dispenser assembly. As discussed in greater detail below, the spigot can contact and actuate the valve mechanism only if the closure 20 has the same coding as the dispenser insert 17. If the code on the closure 20 does not match the code of the dispenser insert 17, the spigot will be prevented from contacting the valve. Accordingly, the contents of the package 18 can not be dispensed.

Figure 3:
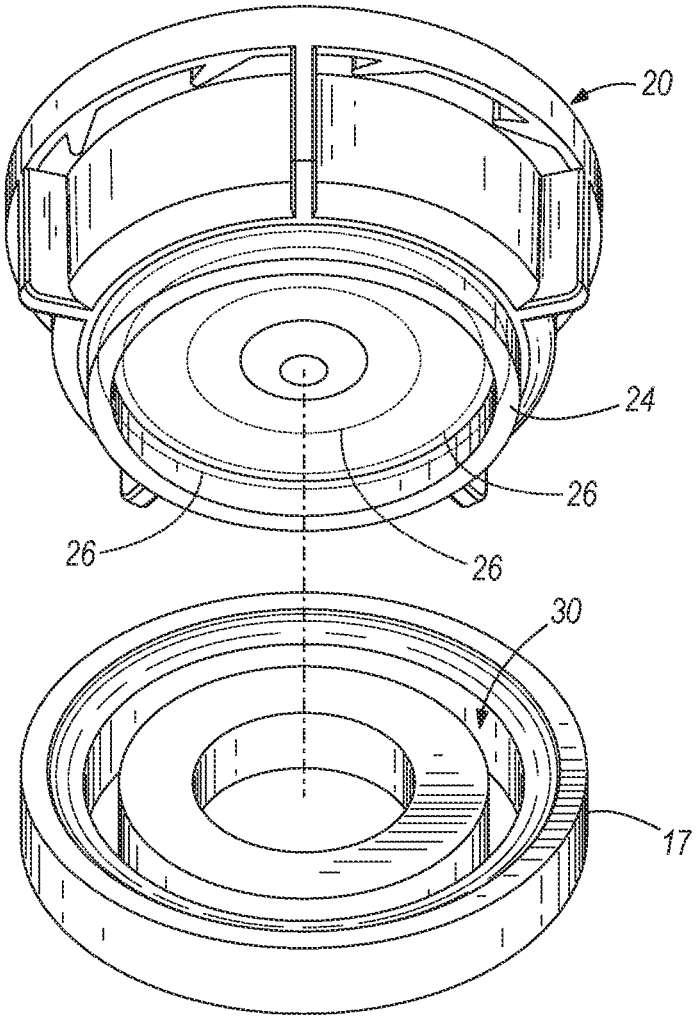
FIG. 3 is a perspective view of a coded dispenser insert and coded package closure embodying aspects of the present invention.
Figure 4:
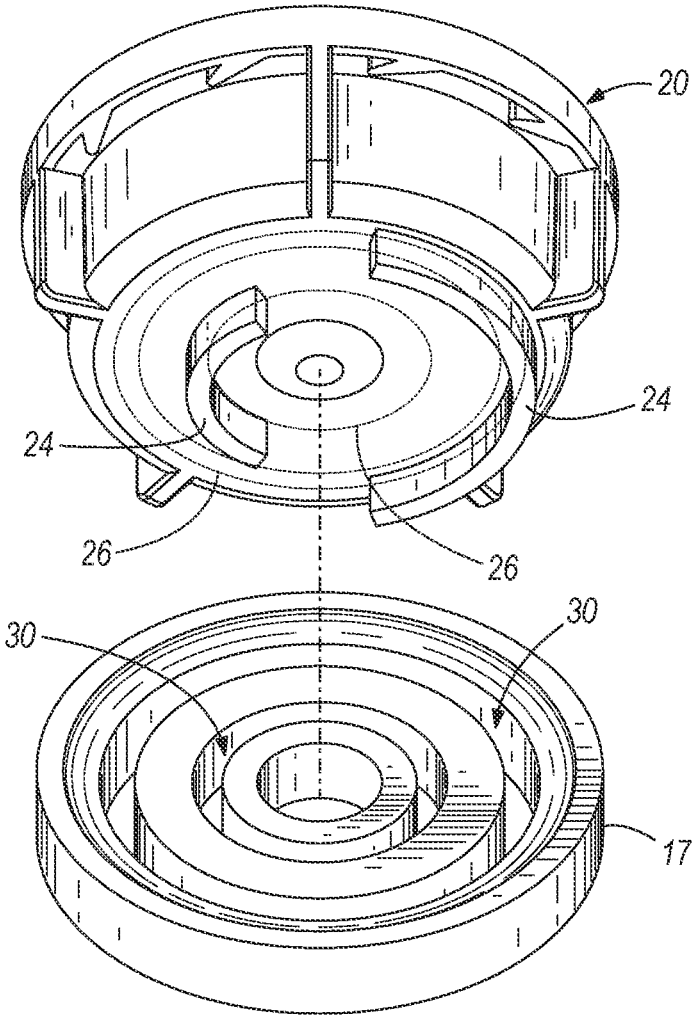
FIG. 4 is a perspective view of a coded dispenser insert and coded package closure embodying aspects of the present invention.

Some embodiments of the present invention utilize a concentric ring lock-out feature to prevent an improperly coded package 18 from engaging a cradle 14. FIGS. 3 and 4 illustrate two different types of matching concentric ring lock-out codings. As shown in each figure, the package closure 20 is provided with one or more projections 24 extending at least partially about the circumference of a circle. The dispensing insert 17 is similarly coded with one or more recesses 30 extending at least partially about the circumference of a circle. In some embodiments, the recesses 30 extend around the entire circumference of the circle to prevent the closure 20 from having to be clocked to allow for engagement between the closure 20 and the insert 17. In a matching set, the dispensing insert 17 has one recess for each projection 24 on the closure 20 and each recess has the same diameter as the projection 24. However, as will be described later, in some embodiments, recesses 30 may be positioned adjacent to each other such that a wall does not separate each recess.

FIG. 3 illustrates one specific embodiment of a matching closure 20 and insert 17. Although concentric rings are not provided on either of the closure 20 or the insert 17, this embodiments operation is based on the same principle. As shown, the ring lock-out coding on the closure 20 matches the coding on the insert 17. Specifically, the illustrated package closure 20 is provided with a projection 24 extending around the entire circumference of a circle having a specific diameter to form a projecting ring 24. The dispensing insert 17 is similarly coded with a recess extending around the entire circumference of a circle having substantially the same diameter as the projection 24 on the closure 20.

FIG. 4 illustrates one way of providing a concentric ring lock-out. As shown, the closure 20 is provided with two concentric ring-like projections 24, and the insert 17 has two matching ring recesses 30. Specifically, the two projections 24 of the closure 20 extend only partially around the circumference of two circles 26 having different diameters. The projecting rings 24 only extend partially around the circumference for one of many reasons, such as to save materials, due to space constraints (i.e., may need room for vents or other features), etc. The dispensing insert 17 is similarly coded with two substantially concentric recesses 30 extending around the entire circumference of circles having substantially the same diameter as the diameter of the circles for the projections 24 on the closure 20.

Although the embodiments shown in FIGS. 3 and 4 show the projections 24 extending only from the closure 20 and the recesses 30 extending into the inserts, other embodiments can be configured differently. For example, this arrangement can be reversed in some embodiments. Accordingly, the recesses 30 can be positioned only on the closure 20, while the projections 24 can be positioned only on the inserts. However, in other embodiments, the closure 20 and the insert 17 can be provided with a combination of both projections 24 and recesses 30.

Due to the space constraints provided by the limited space on a closure 20 and due to manufacturing tolerances, generally only a few concentric rings can be provided on each closure 20 and insert 17. Specifically, each concentric projection 24 requires a certain amount of space to ensure that the projection 24 is robust enough to prevent breakage or deformation from applied forces. More specifically, if the concentric ring projections 24 were not sufficiently strong and the recesses 30 are positioned too close together, there may be a risk that an improperly coded closure 20 could fully engage an incorrect insert 17. Accordingly, some lock-out devices will be limited to only three diameters for the concentric rings. However, other embodiments can utilize more or less diameters depending upon materials selected, closure size, number of features on the closure 20, etc.

Figure 5C:
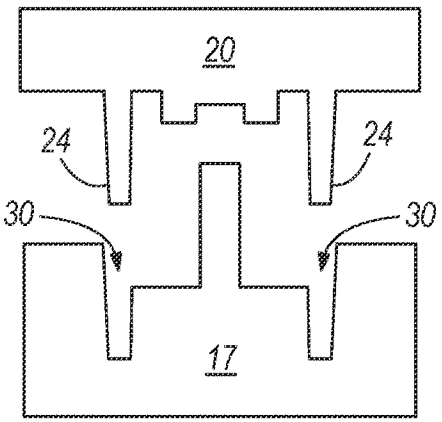
FIGS. 5A-5C are a cross-sectional view of three different coded dispenser inserts and coded package closures embodying aspects of the present invention.
Figure 5B:
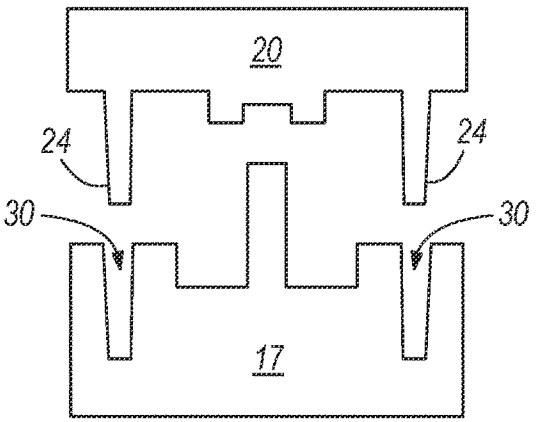
Figure 5A:
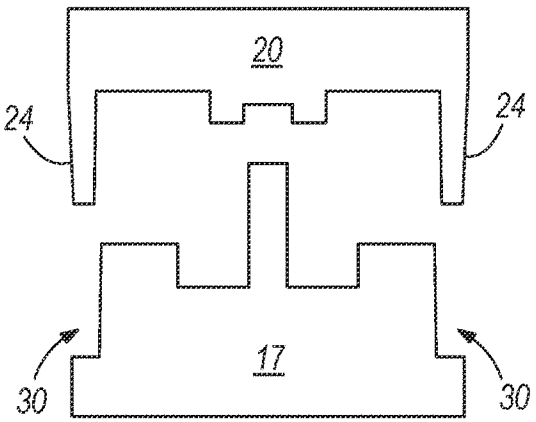
Figure 6A:
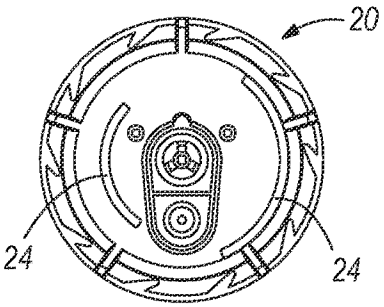
FIGS. 6A-6D are a plan view of four coded package closures having different concentric codings.
Figure 6B:
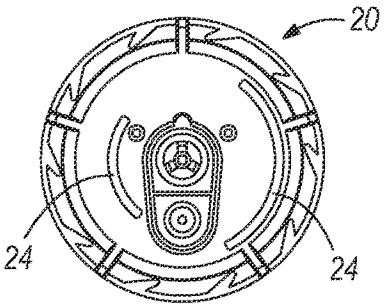
Figure 6C:
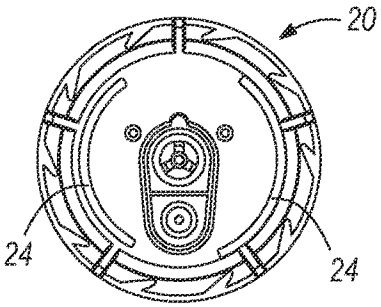
Figure 6D:
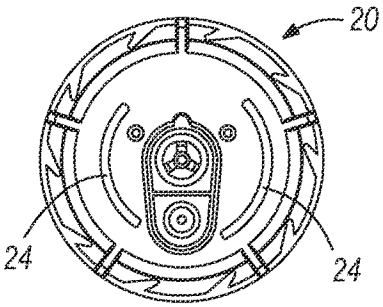
Figure 7A:
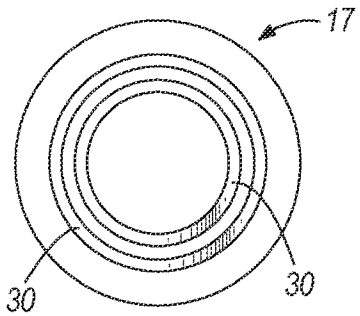
FIGS. 7A-7D are a plan view of four coded dispenser inserts having different concentric codings corresponding to the respective coding shown in FIGS. 6A-6D.
Figure 7B:
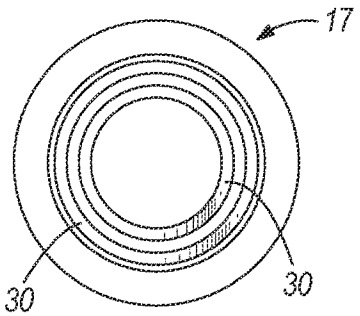
Figure 7C:
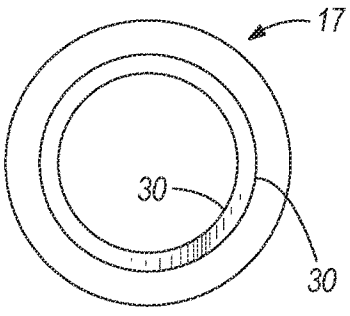
Figure 7D:
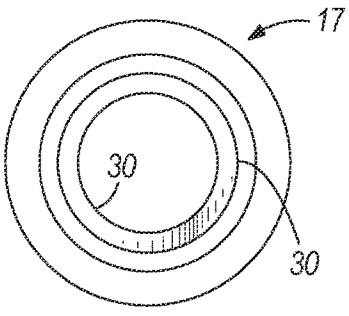

FIG. 5 illustrates three embodiments of a lock-out device 16 having rings positioned at three distinct diameters for the same diameter closure 20 and insert 17. FIGS. 5A-C each show an exemplary closure 20 and matching dispenser insert 17 for the three distinct coding diameters. FIG. 5A illustrates a cross-sectional view of the closure 20 and the insert 17 wherein the ring is positioned near, adjacent, or on the outer diameter of the closure 20 and the insert 17. FIG. 5A illustrates a cross-sectional view of the closure 20 and insert 17 wherein the ring is positioned at a position having a smaller diameter than the diameter of the ring in FIG. 5A. FIG. 5C illustrates a cross-sectional view of the closure 20 and insert 17 wherein the ring is positioned at a position having a smaller diameter than the diameter of the ring in FIG. 5B. The ring positions shown in FIG. 5 are merely exemplary positions wherein the spacing of the rings relative to each other allows the projections 24 to be sufficiently robust and spaces the recesses 30 sufficiently fax apart to prevent an incorrect projection 24 from inadvertently entering an incorrect recess 30. One having skill in this art will understand that additional ring positions could be added to the embodiment illustrated. More specifically, additional ring positions could be added if the materials of the insert 17 and closure 20 are sufficiently strong and robust to prevent breakage, substantial deformation or deflection of projections 24, and the like. Also, other ring positions could be added with manufacturing processes having good tolerance controls. Also, as noted above, the position of the projections 24 and recess 30 can be switched such that the projections 24 extend from the insert 17 and the recesses 30 extend into the closure 20. Further, a combination of recesses 30 and projections 24 can be positioned on both the closure 20 and the insert 17.

FIGS. 6 and 7 illustrate a plan view of exemplary closures (FIG. 6) and exemplary inserts (FIG. 7) having complimentary coding. Specifically, the closure 20 illustrated in FIG. 6A has a complimentary coding to the insert 17 shown in FIG. 7A. Similarly, the codings shown in FIG. 6B-D match the coding shown in FIGS. 7B-D respectively.

As shown in FIG. 6, the closures are provided with various codings by placing projecting rings 24 or portions thereof on different concentric radiuses. Although all possible coding sequences are not shown, the illustrated closure 20 allows rings to be placed at six distinct radiuses. In FIG. 6A, the larger ring portion has the largest radius allowed on the closure 20, while the smaller ring portion shown is the second smallest radius used. The larger ring portion on the closure 20 in FIG. 6B has the second largest radius used, while the smaller ring portion is the smallest radius used. In FIG. 6C, the two ring portions have the largest and second largest radiuses used. In FIG. 6D, the two ring portions are placed at the second and third smallest radiuses used. The radius not illustrated in these figures is the third largest radius. Based upon these illustrations, it should be understood that a wide variety of coding combinations can be achieved by using one or more concentric rings (or portions thereof) on the closure 20. Furthermore, as previously discussed, one or more (or all) rings can be substituted with a similarly sized recess 30.

As shown in FIG. 7, the inserts are provided with various codings by placing recessed rings on different concentric radiuses. Although all possible coding sequences are not shown, the illustrated inserts allow the recessed rings to be placed at six distinct radiuses to correspond with the projecting rings 24 shown in FIG. 7. In FIG. 7A, the larger ring recess 30 has the largest radius allowed on the insert 17, while the smaller ring recess 30 shown is the second smallest radius used. The larger ring recess 30 on the insert 17 in FIG. 7B has the second largest radius used, while the smaller ring recess 30 is the smallest radius used. In FIG. 7C, the two ring recesses 30 have the largest and second largest radiuses used. Furthermore, since the recesses 30 are so close in size, the recesses 30 are contiguous, such that a wall does not separate the two recesses 30. In FIG. 7D, the two ring portions are placed at the second and third smallest radiuses used. Much like the previous figure, since the recesses 30 are so close in size, the recesses 30 are contiguous, such that a wall does not separate the two recesses 30. As mentioned above, one or more (or all) recesses 30 can be substituted with similarly sized projecting rings 24 or portions thereof.

Figure 8:
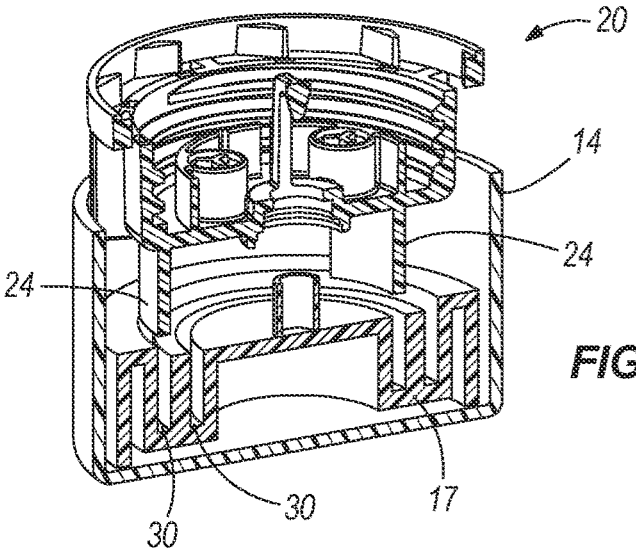
FIG. 8 is a cross-sectional perspective view of a coded closure prior to engagement with a properly coded dispenser insert.
Figure 9:
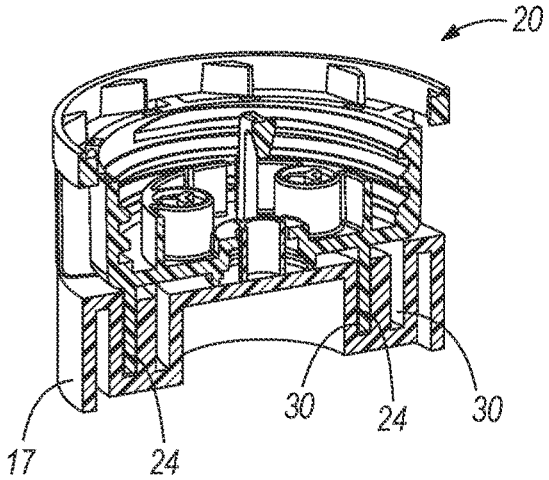
FIG. 9 is a cross-sectional perspective view of a coded closure engaged with a properly coded dispenser insert.

FIGS. 8-9 show how particular embodiments of the lock-out device 16 shown in FIGS. 6 and 7 operate. The closure 20 shown in FIG. 8 has a first projecting ring portion having a first radius and a second projecting ring portion having a second radius that is less than the first radius. The insert 17 provided in FIG. 8 is configured to receive the illustrated closure 20. Accordingly, the insert 17 has a first ring recess 30 having the first radius and a second ring recess 30 having the second radius. The closure 20 is aligned with the insert 17 in this figure. The closure 20 is shown in the properly engaged position in FIG. 9. In other words, the projections 24 properly align with and fit into the recesses 30. Accordingly, the closure 20 will properly engage the dispenser to allow product to be dispensed.

Figure 10:
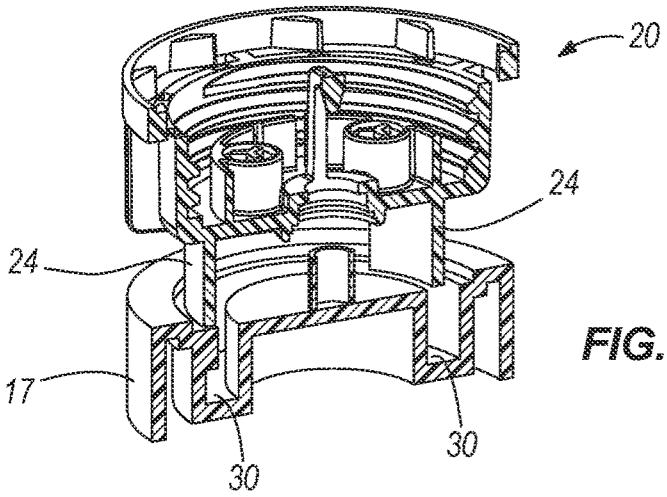
FIG. 10 is a cross-sectional perspective view of a coded closure attempting to engage an improperly coded dispenser insert.

FIG. 10 shows another closure 20 and insert 17 that are not properly coded to each other. The closure 20 has a first projecting ring portion having a first radius and a second projecting ring portion having a second radius that is less than the first radius. The insert 17 has a first ring recess 30 having either the first or the second radius, but the second ring recess 30 has a third radius that is different than the first and second radius. Accordingly, the closure 20 cannot properly engage the insert 17, which should prevent product from dispensing from the container. For the sake of clarity, note that in the illustrated insert 17, the two recesses 30 are not separated by a wall.

Figure 11:
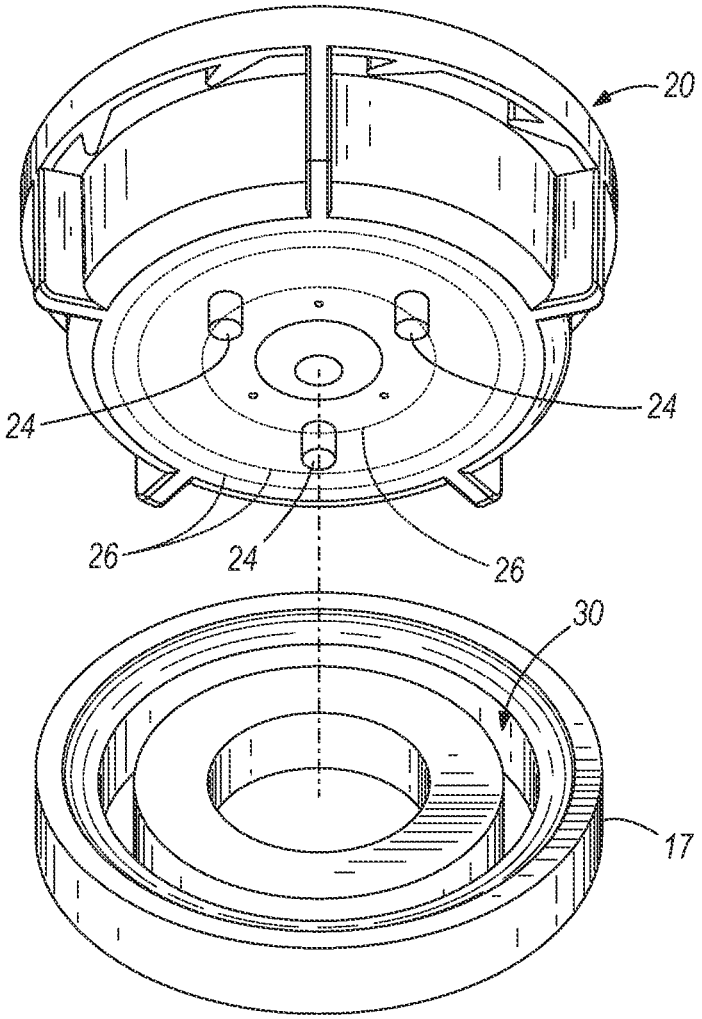
FIG. 11 a perspective view of a coded dispenser insert and coded package closure embodying aspects of the present invention.
Figure 12C:
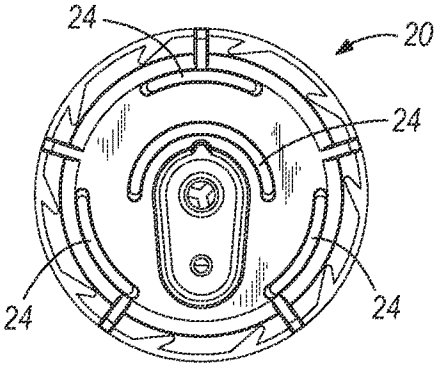
FIGS. 12A-12F are a plan view of six coded package closures having different concentric codings.
Figure 12B:
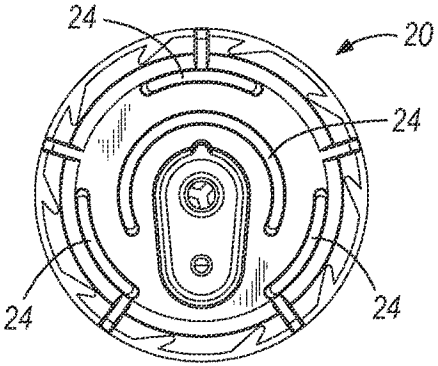
Figure 12A:
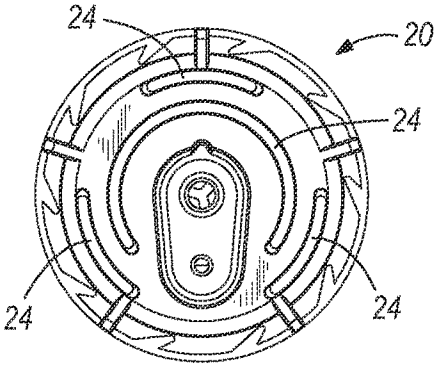
Figure 13C:
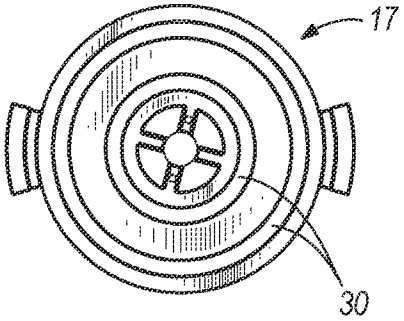
FIGS. 13A-13F are a plan view of six coded dispenser inserts having different concentric codings corresponding to the respective coding shown in FIGS. 12A-12F.
Figure 13B:
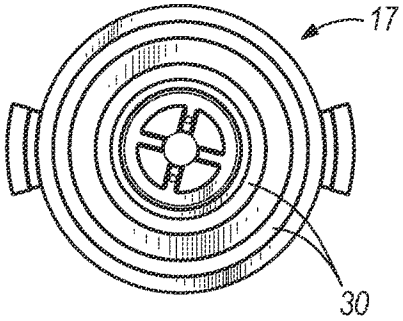
Figure 13A:
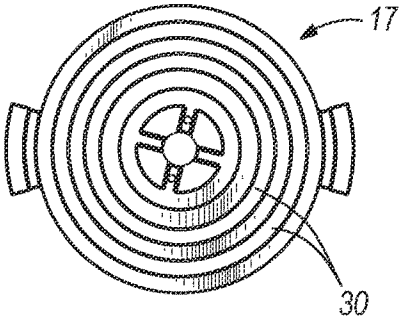
Figure 12F:
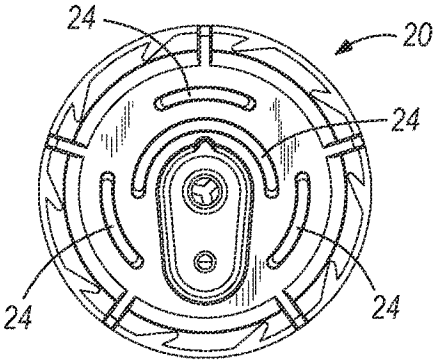
Figure 12E:
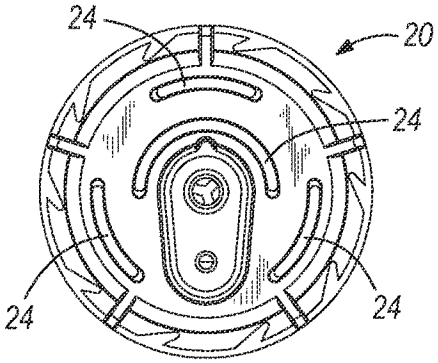
Figure 12D:
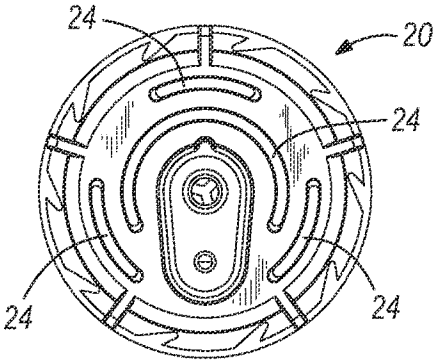
Figure 13F:
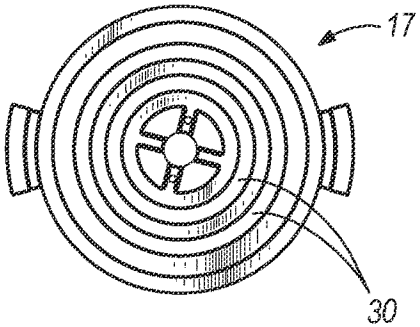
Figure 13E:
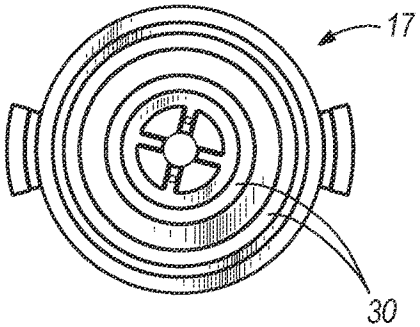
Figure 13D:
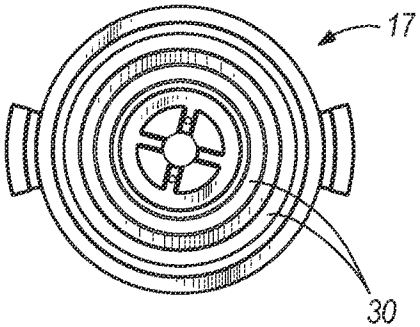
Figure 14A:
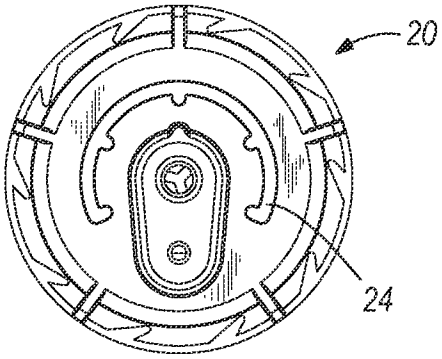
FIGS. 14A-14E are a plan view of five coded package closures having different concentric codings.
Figure 14B:
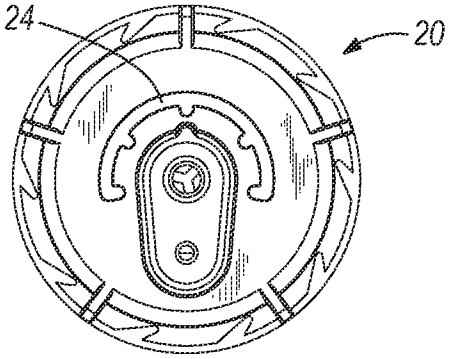
Figure 14C:
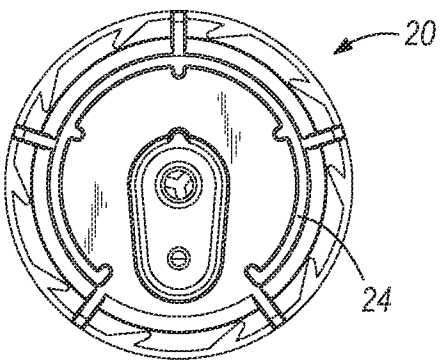
Figure 15A:
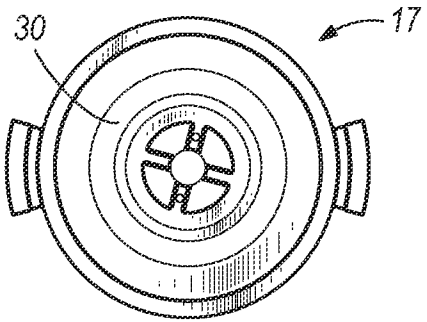
FIGS. 15A-15E are a plan view of five coded dispenser inserts having different concentric codings corresponding to the respective coding shown in FIGS. 14A-14E.
Figure 15B:
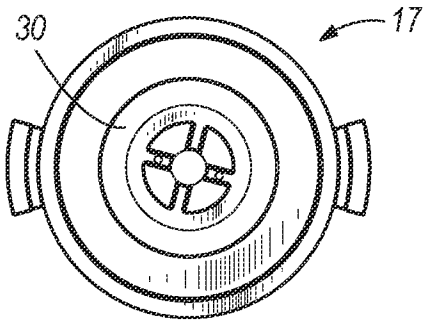
Figure 15C:
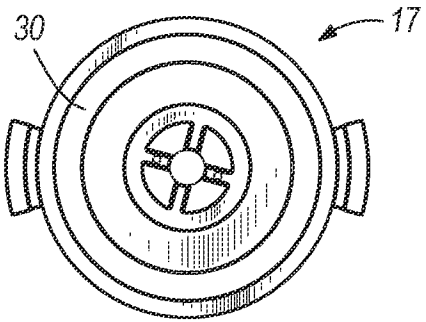
Figure 14E:
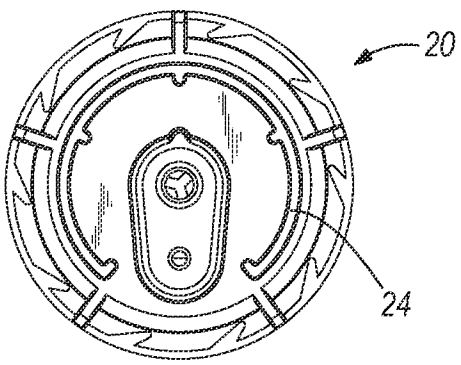
Figure 15E:
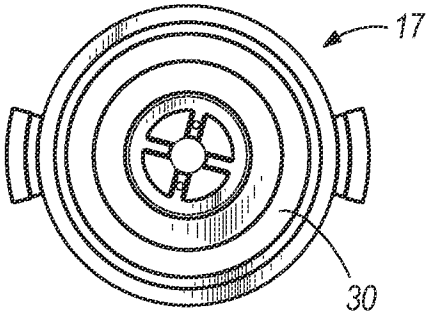
Figure 14D:
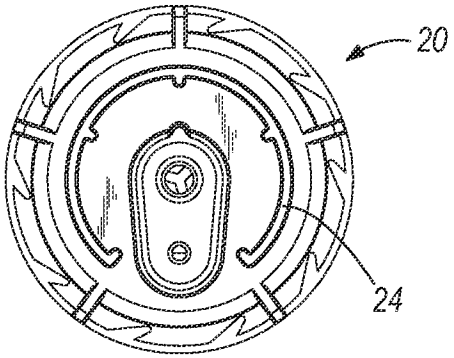
Figure 15D:
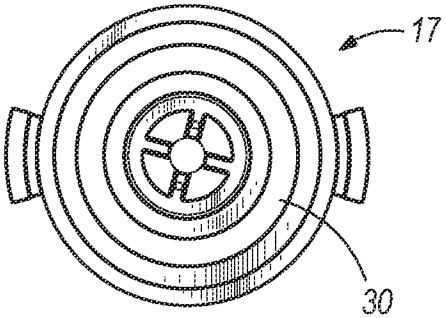

FIG. 11 illustrates an alternative configuration for the projections 24. In this illustrated embodiment, the projections 24 extend from the closure 20. The projections 24 are such small portions of a ring that they appear to be pegs or pins. The three illustrated projections 24 are all on the same radius. In other embodiments, the projections 24 can be.

FIG. 12 illustrates six coded package closures having different concentric codings. FIG. 13 illustrates different concentric codings corresponding to the coding shown in FIG. 12. Specifically, the closure 20 illustrated in FIG. 12A has a complimentary coding to the insert 17 shown in FIG. 13A. Similarly, the codings shown in FIGS. 12B-F match the codings shown in FIGS. 13B-F respectively.

The coded package closures shown in FIG. 12 have many similarities to the package closures shown in FIG. 7. Specifically, the closures are provided with various codings by placing projecting rings 24 or portions thereof on different concentric radiuses. More specifically, each closure 20 illustrated in FIG. 12 has two concentric rings or portions thereof, wherein each ring on a single closure 20 has a different radius. As illustrated, the larger ring on each closure 20 is broken into three sections. These three sections are positioned substantially equidistant apart. The smaller illustrated ring on each closure 20 extends continuously for at least half of the circumference defined by the radius of the ring. As illustrated, the inner ring cannot extend all the way around the circumference due to interference with other objects on the closure 20. As previously discussed, one or more projecting rings 24 on each closure 20 can be substituted with a similarly sized recess 30.

The coded inserts shown in FIG. 13 are substantially similar to the inserts shown in FIG. 7. Specifically, the inserts are provided with various codings by placing recessed rings on different concentric radiuses. One specific difference between this embodiment and the embodiment illustrated in FIG. 7 is that the radiuses selected for each recessed ring (and protecting rings 24) prevent the recesses 30 from intersecting or running into each other. In other words, a wall always separates each recess 30 in this embodiment.

FIG. 14 illustrates five other coded package closures having different concentric codings. FIG. 15 illustrates different concentric codings corresponding to the coding shown in FIG. 14. Specifically, the closure 20 illustrated in FIG. 14A has a complimentary coding to the insert 17 shown in FIG. 15A. Similarly, the codings shown in FIGS. 14B-F match the coding shown in FIGS. 15B-F respectively.

The coded package closures shown in FIG. 14 have many similarities to the package closures shown in FIGS. 7 and 12. Specifically, the closures are provided with various codings by placing projecting rings 24 or portions thereof on different concentric radiuses. This embodiment, however, is unlike the previous embodiment in that only one ring is utilized on each closure 20. Furthermore, each ring is reinforced with ribs to make the ring more robust. These ribs provide enhanced radial depth to each ring. Accordingly, these projecting rings 24 can not be received within the recesses 30 shown in FIG. 14 even though the recesses 30 may have the same diameter.

The coded inserts shown in FIG. 15 are substantially similar to the inserts shown in FIGS. 7 and 13. Specifically, the inserts are provided with various codings by placing one or more recessed rings on different concentric radiuses. The illustrated embodiment only provides one recessed ring per insert 17 to correspond with design of the closure 20.

The embodiments described above and illustrate in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

Various features of the invention are set forth in the following claims.

The invention claimed is:

1. A lock-out assembly for controlling engagement between a package and a dispensing apparatus having a cradle, the lock-out assembly comprising:

a closure attachable to the package and including a first mating surface;

a selectively movable insert removably receivable in the cradle and having a second mating surface;

a recess positioned on one of the first mating surface or the second mating surface; and a projection positioned on the other of the first mating surface or the second mating surface, wherein the projection is dimensioned and configured to releasably mate with the recess to engage the package with the dispensing apparatus.

2. The lock-out assembly of claim 1, wherein the projection includes a rib, and wherein the projection and the rib releasably engage the recess.

3. The lock-out assembly of claim 1, wherein the recess is annular.

4. The lock-out assembly of claim 3, wherein the projection is annular.

5. The lock-out assembly of claim 1, wherein the recess is a first recess and the lock-out assembly further includes a second recess that is concentric with the first recess, and wherein the second recess is positioned on one of the first mating surface or the second mating surface.

6. The lock-out assembly of claim 5, wherein the projection is a first projection and the lock-out assembly further includes a second projection that is concentric with the first projection and that is positioned on the other of the first mating surface or the second mating surface, and wherein the second projection is engageable with the second recess.

7. The lock-out assembly of claim 1, wherein the recess is positioned about at least a portion of a circumference of a circle having a first diameter.

8. The lock-out assembly of claim 7, wherein the projection is positioned about at least a portion of a circumference of a circle having the first diameter.

9. The lock-out assembly of claim 8, wherein the recess extends around the entire circumference of the circle having the first diameter.

10. The lock-out assembly of claim 8, wherein the projection extends around only a portion of the circumference of the circle having the first diameter.

11. A dispensing apparatus comprising:

a package containing a product to be dispensed, the package including a closure defined by a closure mating surface having a projection or a recess;

a dispensing location including a cradle; and a selectively movable insert removably received in the cradle, the insert having an insert mating surface releasably mating with the closure mating surface, the insert mating surface having the other of a recess or a projection, the closure mating surface cooperating with the insert mating surface to engage the package with the dispensing location such that the product can be dispensed from the first package.

12. The dispensing apparatus of claim 11, wherein the closure is selectively removable from the package.

13. The dispensing apparatus of claim 11, wherein the projection includes a rib, and wherein the projection and the rib releasably engage the recess.

14. The dispensing apparatus of claim 11, wherein the projection includes a plurality of projections.

15. The dispensing apparatus of claim 11, wherein the projection includes a plurality of concentric projections, and the recess includes a plurality of concentric recesses complementary to the plurality of concentric projections.

16. The dispensing apparatus of claim 11 wherein the projection includes a first projection that extends a first distance, and a second projection that extends a second distance, wherein the first and second distances share the same center of origin, wherein the second distance is different from the first distance, and wherein the recess includes a first recess that is complementary to the first projection, and a second recess that is complementary to the second projection.

17. The dispensing apparatus of claim 11, wherein the closure mating surface is a first closure mating surface, the dispensing apparatus further comprising:

a second package containing a second product to be dispensed, the second package including a second closure defined by a second closure mating surface having a projection or a recess;

a second dispensing location including a second cradle; and a second selectively movable insert removably received in the second cradle, the second insert having a second insert mating surface releasably mating with the second closure mating surface, the second insert mating surface having the other of the recess or the projection;

wherein the positioning of the projections and the recesses allow the second package to engage the second dispensing location such that the second product can be dispensed from the second package; and wherein the positioning of the projections and the recesses prevent the first package from engaging the second dispensing location to dispense the first product and prevent the second package from engaging the first dispensing location to dispense the second product.

18. The dispensing apparatus of claim 11, wherein the projection is positioned about a circle having a diameter, and wherein the recess is positioned about a circle having the diameter.

19. The dispensing apparatus of claim 18, wherein the projection extends only partially around the circle having the diameter.

20. The dispensing apparatus of claim 18, wherein the recess extends around the entire circle having the diameter.

* * * * *